US005609503A

United States Patent [19]

Tsuji et al.

[11] Patent Number: 5,609,503

[45] Date of Patent: Mar. 11, 1997

[54] DOUBLE-LOCK TYPE CONNECTOR

[75] Inventors: Masanori Tsuji; Keishi Jinno, both of Shizuoka, Japan

[73] Assignee: Yazaki Corporation, Tokyo, Japan

[21] Appl. No.: 435,787

[22] Filed: May 5, 1995

[30] Foreign Application Priority Data

May 30, 1994 [JP] Japan ..... 6-116865

[51] Int. Cl.[6] ..... H01R 13/514

[52] U.S. Cl. ..... 439/752; 439/733.1

[58] Field of Search ..... 439/741, 733, 439/752, 595

[56] References Cited

U.S. PATENT DOCUMENTS

| | | | |
|---|---|---|---|
| 4,867,712 | 9/1989 | Kato et al. | 439/752 |
| 5,316,504 | 5/1994 | Jinno | 439/752 |
| 5,322,456 | 6/1994 | Yagi et al. | 439/752 |
| 5,501,619 | 3/1996 | Sakatani et al. | 439/752 |

FOREIGN PATENT DOCUMENTS 4-26190 5/1992 Japan .

*Primary Examiner*—David L. Pirlot

*Attorney, Agent, or Firm*—Sughrue, Mion, Zinn, Macpeak & Seas

[57] ABSTRACT

In a double-lock type connector, terminals are primarily locked when inserted into terminal accommodating chambers in a connector housing, and the top wall of a spacer is depressed so that the latter is locked to the connector housing, thereby to secondarily lock the terminals. In the double-lock type connector, the spacer has a pair of elastically deformable flexible wall which are confronted with each other with a predetermined space between them and have first engaging parts on their inner surfaces which are confronted with each others, and the connector housing has a protruded portion which is slidably engaged with the flexible walls and has second engaging parts which are engageable with the first engaging part.

4 Claims, 7 Drawing Sheets

DOUBLE-LOCK TYPE CONNECTOR

BACKGROUND OF THE INVENTION

1. Field of the Invention

This invention relates to a double-lock type connector in which terminals are fixedly secured not only by flexible locking arms provided in terminal accommodating chambers but also by a spacer which is inserted in such a manner as to cross the terminal accommodating chambers.

2. Related Art

In general, in the terminal accommodating chambers of a connector, flexible locking arms (hereinafter referred to as "lances", when applicable) are provided to prevent the removal of the terminals. However, in the case of a miniaturized connector, the lances are limited in dimension, and therefore their terminal holding forces may not be large enough. In this case, in addition to the lances, a terminal locking member is provided to doubly lock the terminals.

An example of the double-lock type connector of this type in which the terminal locking member is set in the terminal accommodating chambers to doubly lock the terminals, has been disclosed, for instance, by Japanese Patent Application (OPI) No. 54677/1989 (the term "OPI" as used herein means an "unexamined application"). The double-lock type connector is as shown in FIGS. 13 through 15. FIG. 13 is an exploded perspective view of a conventional double-lock type connector having a spacer which serves as the terminal locking member, FIG. 14 is a sectional view showing the spacer which is temporarily locked, and FIG. 15 is a sectional view showing the spacer which is finally locked.

A connector housing 51 has terminal accommodating chambers 53 arranged in three layers. Each of the terminal accommodating chambers 53 has a lance 54 which is adapted to primarily lock a terminal 55 (cf. FIGS. 14 and 15). A cavity 57 is formed in the middle of the connector housing 51 in such a manner that it is extended across the terminal accommodating chambers 53 and opened in the upper wall 51*a* of the connector housing 51. A terminal locking member 61 (hereinafter referred to as "a spacer 61", when applicable) is inserted into the cavity 57. The spacer 61 comprises a top wall 63 and a plurality of leg-walls 62 extended downwardly from the top wall 63. The leg-walls 62 are arranged in alignment with partition walls 58 which separate the terminal accommodating chambers 53 from one another. A plurality of terminal locking fins 64 are extended from the right and left surfaces of the leg-walls 62 so that they are engageable with the terminals 55 inserted into the terminal accommodating chambers 53. The spacer 61 is inserted into the cavity 57 in two steps. In the first step, the spacer 61 is temporarily locked, and in the second step it is finally locked. When the spacer 61 is temporarily locked as shown in FIG. 14 (hereinafter referred to as "a temporary locking state", when applicable), given terminals 55 can be inserted between the leg-walls 62. When, after the insertion of the terminals 55, the spacer 61 is further depressed, the spacer 61 is finally locked as shown in FIG. 15 (hereinafter referred to as "a final locking state", when applicable). That is, with the spacer in the temporary locking state, the lances 54 are engaged with the locking holes 75 (FIG. 13) of the terminals 55; that is, the terminals 55 are primarily locked. With the spacer inn the final locking state, the terminal locking fins 64 are engaged with a pair of locking pieces 76 protruded from each of the terminals 55; that is, the latter 55 are secondarily locked. Thus, the terminals 55 have been doubly locked.

The spacer 61 has a plurality of locking protrusions 65 which are extended from one edge of the top wall 63. When the spacer 61 is in the temporary locking state, the locking protrusions 65, being located along the edge of the opening of the cavity 57, clamp the upper wall 51*a* of the connector housing 51; and when the spacer 61 is in the final locking state, the locking protrusions 65 are engaged with the inner surface 51*a* of the upper wall 51*a* of the connector housing, thus fixedly locking the spacer 61.

The above-described conventional double-lock type connector suffers from the following difficulties: If the insertion of the terminal 55 into the terminal accommodating chamber is incomplete, then the terminal locking fins 64 striking against with the locking pieces 76 of the terminal 55, so that the top wall 63 of the spacer 61 is raised, and accordingly it is impossible to lock the locking protrusions 65 of the spacer 61 to the upper wall of the connector housing 51 along the edge of the opening of the cavity 57. This means that the spacer 61 will not function to properly prevent the removal of the terminals 55, or to permit an easy determination of whether or not the terminals 55 are satisfactorily inserted into the connector housing 51. However, the double-lock type connector is disadvantageous in the following point: In the case where the insertion of at least one of the terminals 55 is unsatisfactory, the spacer 61 is partially raised, but the locking protrusions 65 are engaged with the connector housing 51 in the region where the terminals are correctly inserted. Hence, it is difficult for a visual inspection or an inspection with a checker to accurately detect the states of the inserted terminals.

Once the locking protrusions 65 are engaged with connector housing, then they are made dull. Hence, in using the spacer, it is impossible to smoothly engage the spacer with the connector housing.

SUMMARY OF THE INVENTION

In view of the foregoing, an object of the invention is to provide a double-lock type connector in which it can be positively detected whether or not terminals have been correctly inserted into the connector housing, and even if the spacer is repeatedly placed in the temporary locking state and in the final locking state, it can be smoothly and satisfactorily locked to the connector housing at all times.

The foregoing object of the invention has been achieved by the provision of a double-lock type connector comprising: a connector housing including terminal accommodating chambers, the connector housing having a cavity which is extended across the terminal accommodating chambers, and opened in the outer wall of the connector housing; and a spacer which is inserted into the cavity and held in two steps being placed in a temporary locking state and in a final locking state, wherein the spacer includes: a top wall which is similar in configuration to the cavity; and a pair of elastically deformable flexible walls which are extended downwardly from the top wall and spaced from each other, and the connector housing has a protruded portion inside with which the flexible walls are slidably engaged, and when the spacer, being inclined, tends to be placed in the final locking state from the temporary locking state, the spacer is placed in the temporary locking state again by the elastic restoring force of the flexible walls.

In the double-lock type connector, according to the invention, temporary locking means for placing the spacer in the temporary locking state, and final locking means for placing the spacer in the final locking state are provided between the spacer and the connector housing, the temporary locking means and the final locking means being provided by means comprising first engaging parts formed on the inner surfaces of the flexible walls, and second engaging parts formed on the outer surface of the protruded portion so as to be engaged with the first engaging parts and/or means comprising an elastic locking pawl formed on the edge of the top wall 8, and the edge portion of the opening of the cavity.

In the double-lock type connector, according to the invention, the first engaging parts are protrusions (or recesses), while the second engaging parts are recesses (or protrusions).

When, in the case where the insertion of a terminal into the connector housing is incomplete, the state of the spacer is switched over to the final locking state from the temporary locking state, then the spacer strikes against the terminal. As a result, the spacer is tilted, and the spacer is depressed on the side only where the terminals are satisfactorily inserted into the connector housing. At the same time, the right and left flexible walls of the spacer are pushed outwardly with their inner surfaces being abutted against the protruded portion of the connector housing. As a result, a restoring force of the flexible walls thus elastically deformed provides a moment which acts on the spacer as follows: When the spacer is released; that is, upon the removal of the spacer depressing force, the moment acts as a force to raise the spacer as a whole, so that the spacer is placed in the temporary locking state again. Hence, the double-lock type connector of the invention is free from the difficulty that the spacer, being tilted, is partially engaged with the connector housing. Hence, during inspection, it can be readily determined whether or not the terminals have been correctly inserted into the connector housing.

BRIEF DESCRIPTION OF THE DRAWING(S)

Figure 4:
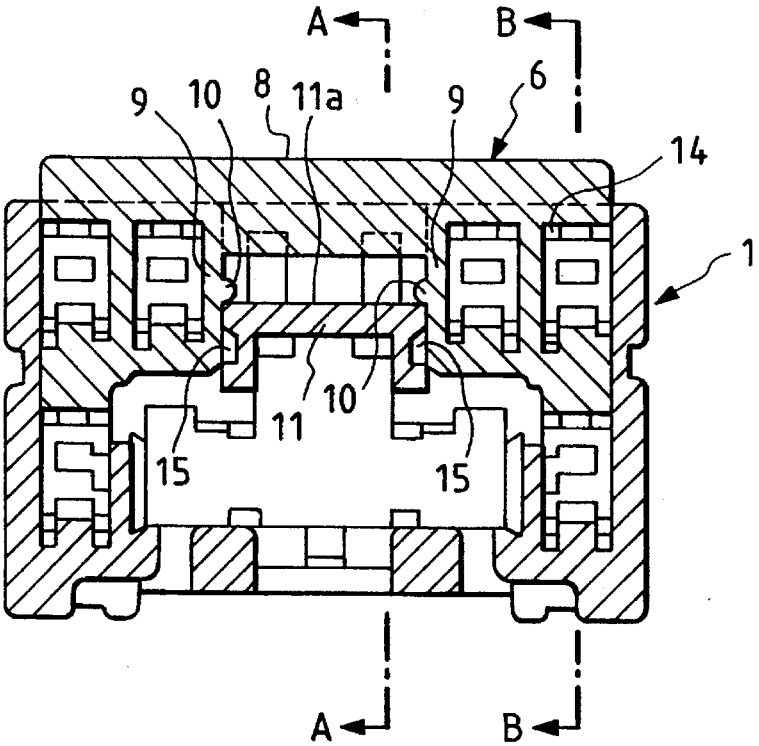
FIG. 4 is a sectional view taken along line C—C in FIG. 1, showing the spacer which is in a temporary locking state.
Figure 8:
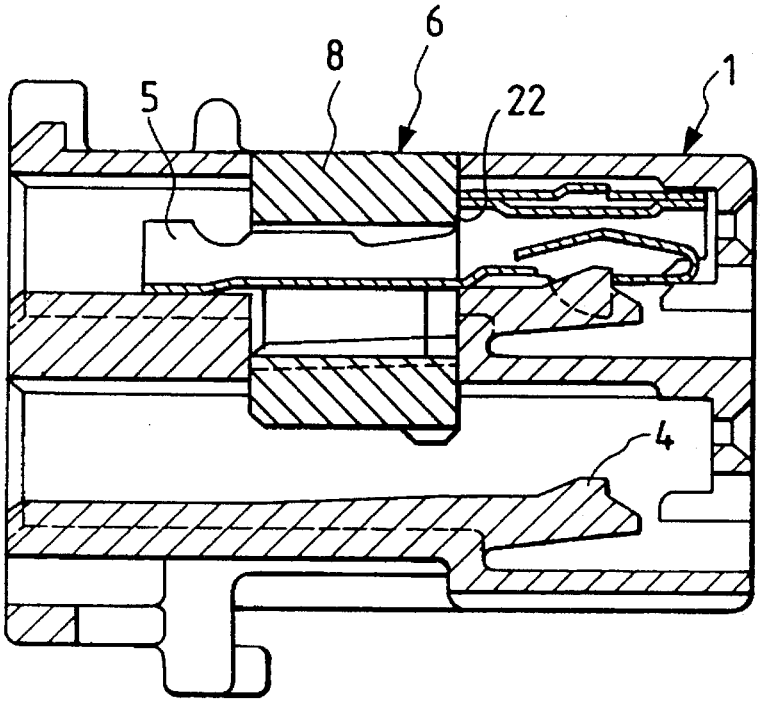
Figure 9:
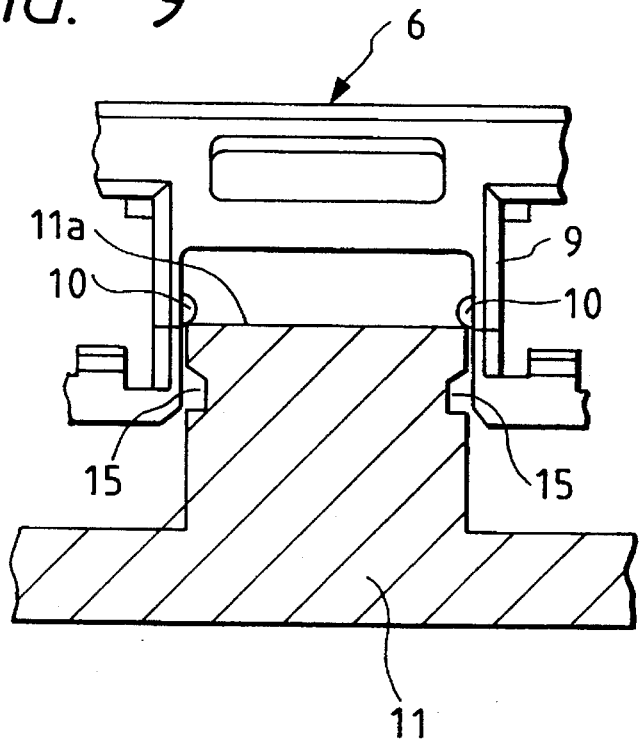
Figure 10:
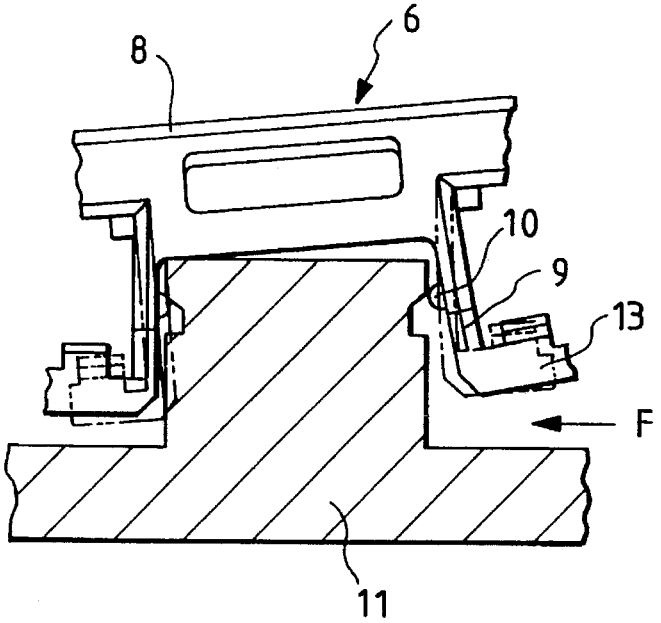
Figure 11:
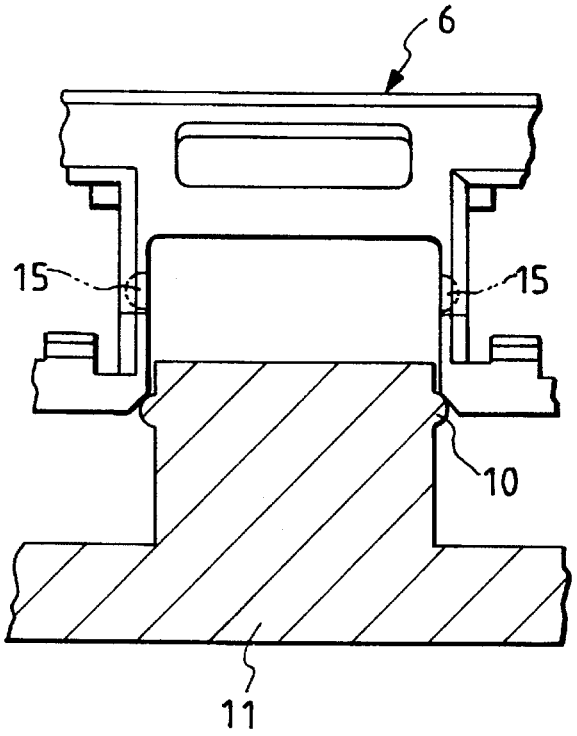
Figure 12:
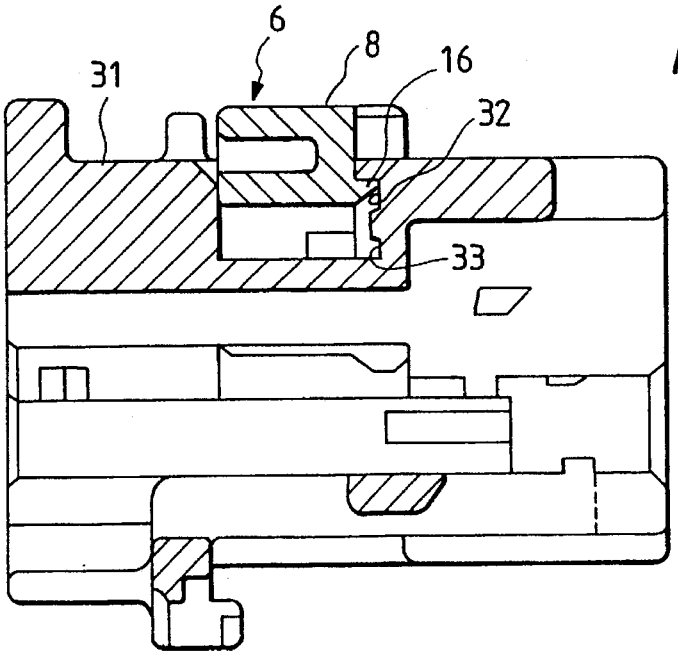
Figure 13:
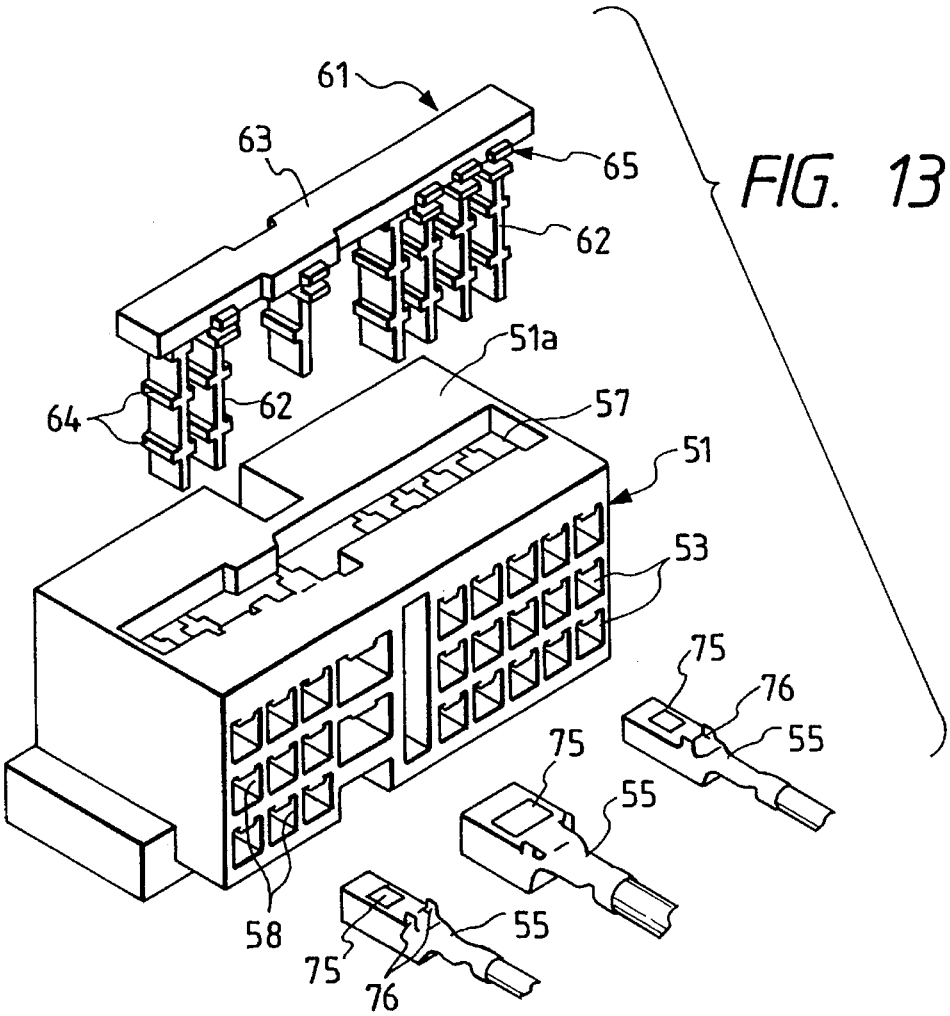
Figure 14:
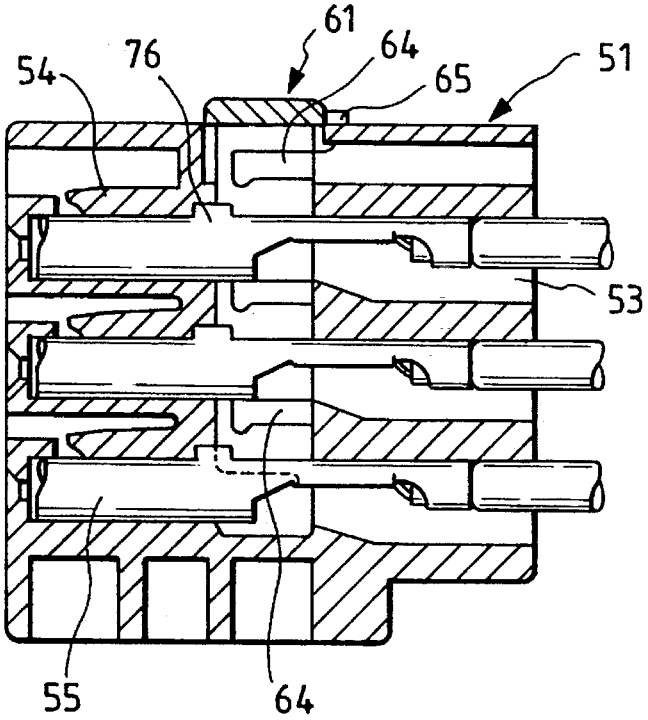
Figure 15:
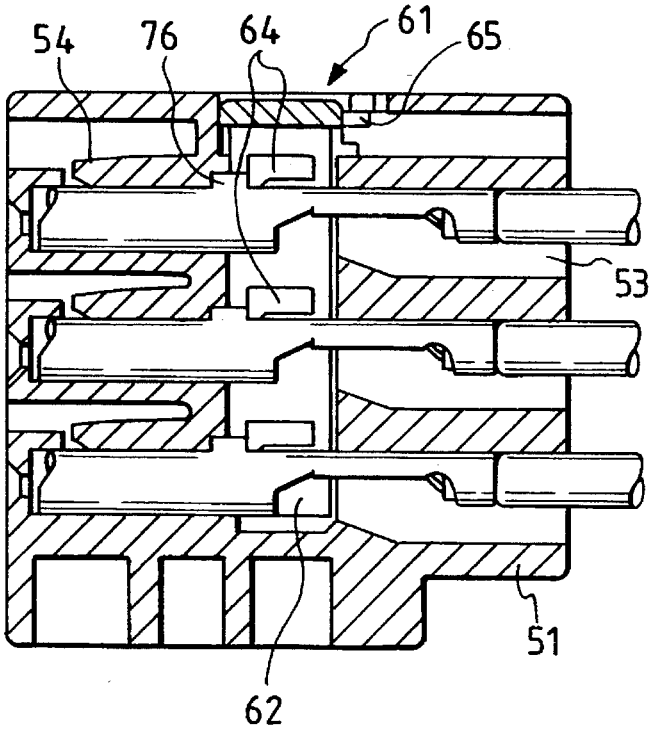

FIG. 8 ms a sectional view as in FIG. 4, showing the spacer which is in the final locking state;

FIG. 9 is a diagram outlining a spacer locking mechanism;

FIG. 10 is a diagram for a description of the operation of the spacer locking mechanism;

FIG. 11 is a sectional view showing one modification of the spacer locking mechanism;

FIG. 12 is a sectional view showing essential components of a second embodiment of the invention;

FIG. 13 is a perspective view of a conventional double-lock type connector;

FIG. 14 is a sectional view showing a spacer in the conventional double-lock type connector which is in a temporary locking state; and FIG. 15 is a sectional view showing the spacer in the conventional double-lock type connector which is in a final locking state.

DETAILED DESCRIPTION OF THE PREFERRED EMBODIMENT

A double-lock type connector, which constitutes a first embodiment of the invention, will be described with reference to FIGS. 1 through 8.

Figure 1:
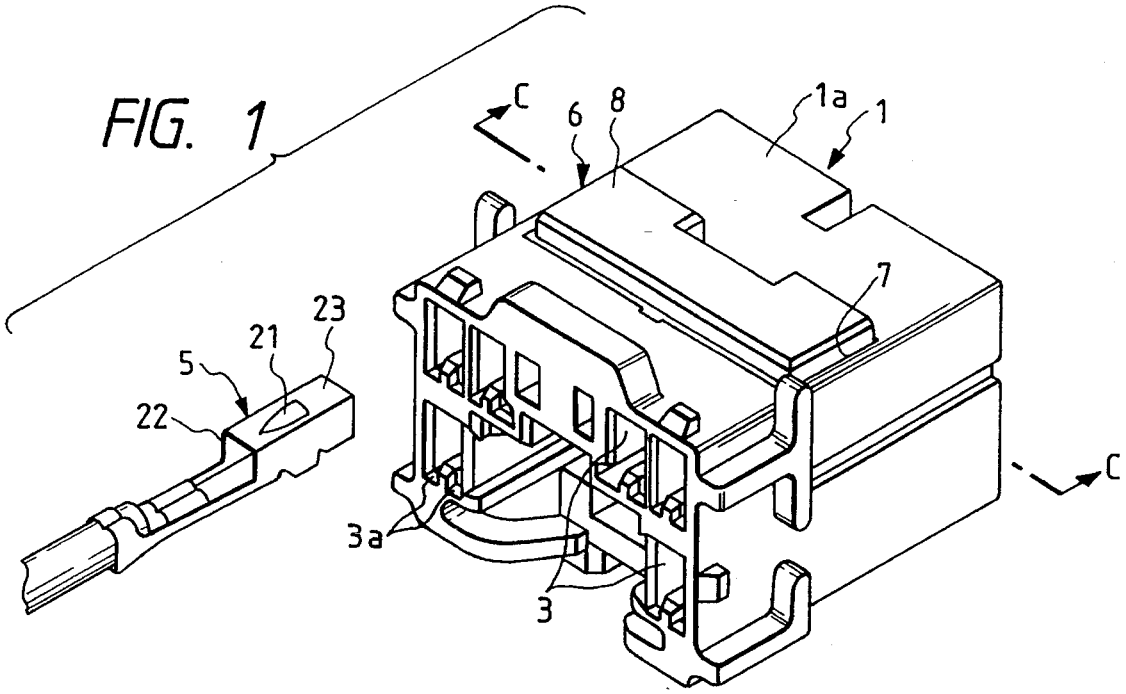
FIG. 1 is a perspective view of a double-lock type connector, which constitutes a first embodiment of the invention.
Figure 2:
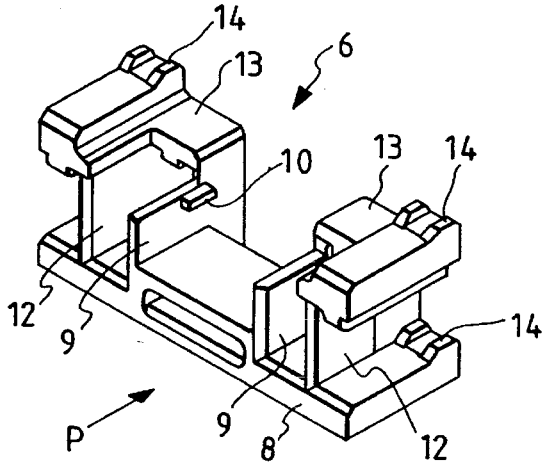
FIG. 2 is a perspective rear view of a spacer employed in the double-lock type connector.
Figure 3:
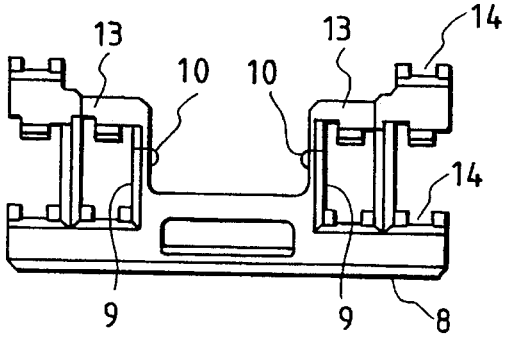
FIG. 3 is a view taken in the direction of the arrow P in FIG. 2, showing the spacer.
Figure 5:
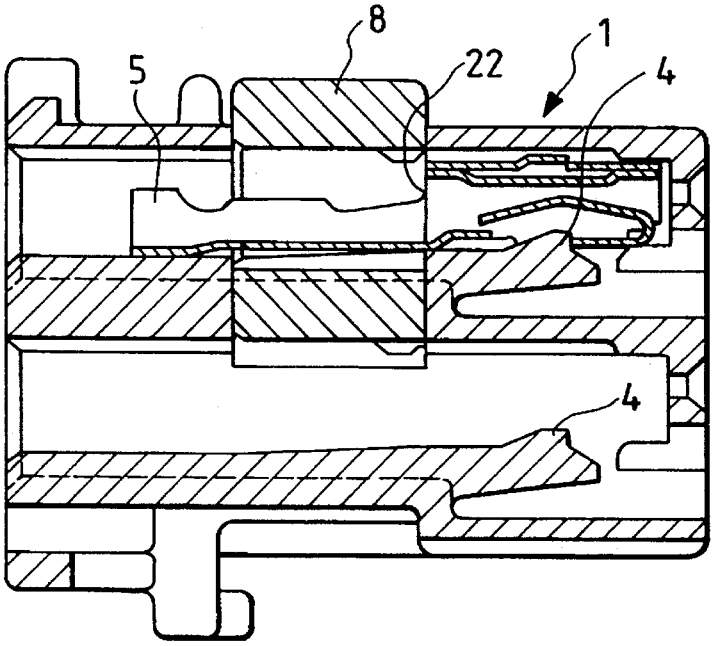
FIG. 5 is a sectional view taken along line B—B in FIG. 4.
Figure 6:
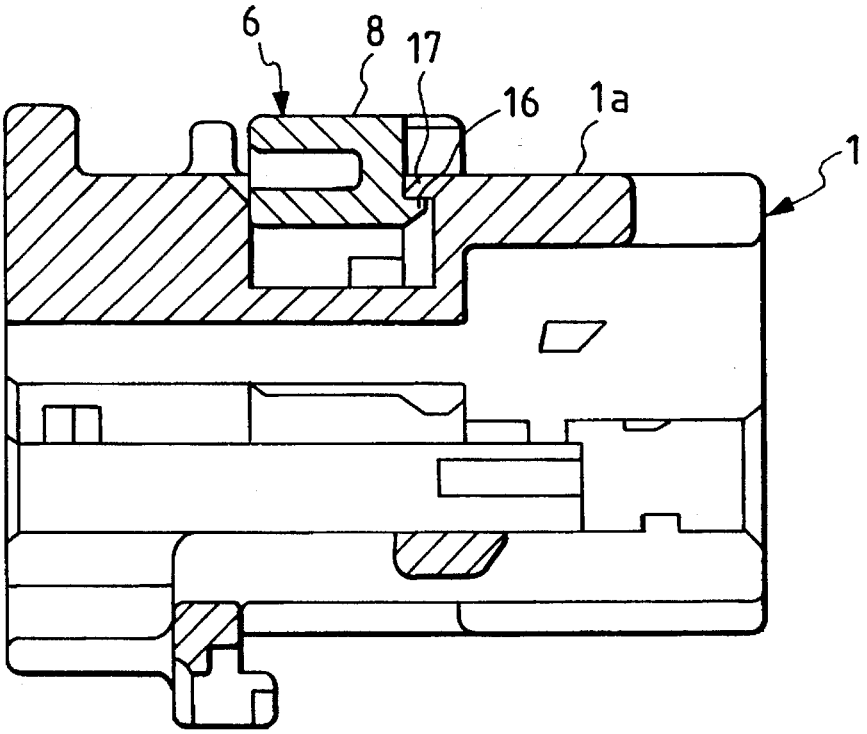
FIG. 6 is a sectional view taken along line A—A in FIG. 4.
Figure 7:
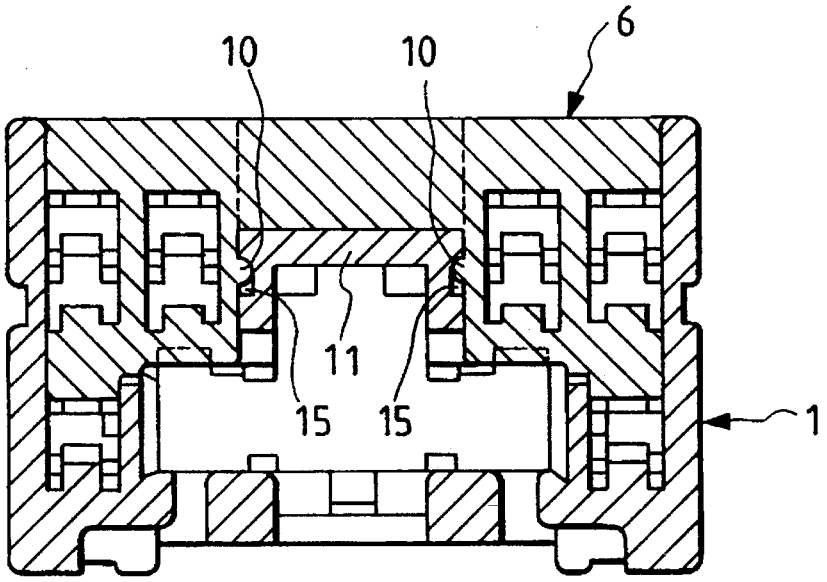
FIG. 7 is a sectional view taken along line C—C in FIG. 1, showing the spacer which is in a final locking state.

FIG. 1 is a perspective view of the double-lock type connector according to the invention. FIG. 2 is a perspective rear view of a spacer. FIG. 3 is a front view of the spacer. FIG. 4 is a sectional view taken along line C—C in FIG. 1. FIG. 5 is a sectional view taken along line B—B in FIG. 4, showing the spacer which is temporarily locked. FIG. 6 is a sectional view taken along line A—A in FIG. 4, showing the spacer which is temporarily locked. FIG. 7 is a sectional view showing the spacer which is finally locked. FIG. 8 is a sectional view taken along line B—B in FIG. 4, showing the spacer which is finally locked.

A connector housing 1 has terminal accommodating chambers 3 arranged in plural layers (two layers in the embodiment). Each of the terminal accommodating chambers 3 has a lance 4 (cf. FIG. 5) which is primarily connected to a terminal 5 inserted into the terminal accommodating chamber 3. A cavity 7 is formed substantially in the middle of the connector housing 1 in such a manner that it is extended across the terminal accommodating chambers 3 and opened upwardly in the upper wall 1*a* of the connector housing 1.

The spacer 6 includes: a top wall 8 which is so shaped as to sealingly close the opening of the cavity 7; a pair of flexible walls 9 which are extended downwardly from the top wall 8 and are confronted with each other with a predetermined space between them; a pair of locking protrusions (or first engaging parts which engage with second engaging parts (described later)) 10 formed on the inner surfaces of the flexible walls 9 which are confronted with each other, respectively; and a pair of outer walls 12 which are provided outside the flexible walls 9, respectively. When the spacer is inserted into the connector housing 1, the outer walls 12 together with flexible walls 9 define the terminal accommodating chambers 3 partially.

The ends of the outer walls 12 are coupled through a pair of coupling walls 13 to the ends of the flexible walls 9, respectively. Pairs of terminal locking pieces 14 are formed on the inner surfaces of the coupling walls 13 and the top wall 8. When the spacer 6 is temporarily locked to the connector housing 1, the terminal locking pieces 14 are not in the terminal locking chambers 3; and when the spacer 6 is finally locked to the connector housing 1, the terminal locking pieces 14 enter the terminal locking chambers 3 to engage with the terminals 5.

When the spacer 6 is inserted into the cavity 7, it is engaged with the connector housing 1 in two steps—in the first step, it is temporarily locked to the connector housing 1 (hereinafter referred to as "a temporary locking state", when applicable), and in the second step, it is finally locked to the connector housing 1 (hereinafter referred to as "a final locking state", when applicable). In the temporary locking state, as shown in FIG. 6 an elastic locking pawl 16 formed on the edge of the top wall 8 is engaged with the edge portion 17 of the opening of the cavity 7 and then engaged with the inner surface of the edge portion 17, thus being locked to the connector housing 1. In the final locking state, as shown in FIGS. 7 and 8 the spacer 8 is completely fitted in the cavity 7, thus being positively locked to the connector housing 1. As shown in FIGS. 4 and 7, the connector housing 1 has a protruded portion 11 substantially at the center of the cavity 7. The protruded portion 11 is substantially U-shaped in section. The protruded portion 11 is formed as a part of the connector housing 1 when molded so that the flexible walls 9 of the spacer 6 are slidably engaged with the protruded portion 11.

More specifically, the protruded portion 11 is substantially equal in width to the distance between the flexible walls 9 of the spacer 6, and has a substantially flat upper wall 11*a* whose right and left ends are chamfered. Hence, when the spacer 6 is temporarily locked to the housing 1, the locking protrusions 10 are abutted against the upper wall 11*a*, so that the spacer 6 is held in parallel with the connector housing 10. The right and left walls of the protruded portion 11 have engaging grooves (or second engaging parts) 15 and 15, respectively, which function as follows. That is, when the spacer 6 is finally locked to the connector housing 1, the locking protrusions 10 are engaged with the engaging grooves 15 to positively prevent the removal of the spacer 6 from the connector housing 1.

In the above-described embodiment, temporary locking means is made up of the elastic locking pawl 16 and the edge portion 17 of the opening of the cavity (hereinafter referred to as "an opening edge portion 17", when applicable). In this connection, final locking means may be formed by providing an engaging protrusion at the part to which, when the spacer is finally locked to the connector housing, the elastic locking pawl 16 is locked. Hence, the locking means using the locking pawl 16 and the locking means using the locking protrusions 10 may be selectively used, or may be used in combination. In the embodiment, the locking pawl 16 is a part of the temporary locking means, which simplifies the structure of the housing. In addition, the difficulty that when the locking pawl 16 is made dull, it is impossible to smoothly lock the spacer to the connector housing, may be eliminated by using the locking protrusions 10 in combination with the locking pawl 16. The above-described feature improves the mechanical strength of the temporary locking means and the final locking means.

The assembly of the double-lock type connector 1 will be described with reference to FIGS. 4 through 8. As was described above, FIG. 4 is a sectional view taken along line C—C in FIG. 1, FIG. 5 is a sectional view taken along line B—B in FIG. 4, showing the spacer which is temporarily locked to the housing, FIG. 6 is a sectional view taken along line A—A in FIG. 4, showing the spacer which is temporarily locked to the connector housing, and FIGS. 7 and 8 (corresponding to FIGS. 4 and 5) are sectional views showing the spacer which is finally locked to the connector housing.

The spacer is inserted into the cavity 7 as follows: First, the flexible walls 9 are inserted into the cavity 7 until, as shown in FIG. 4, the locking protrusions 10 of the flexible walls 9 abut against the upper wall 11*a* of the protruded portion 11. When the locking protrusions 10 abut against the upper wall 11*a* of the protruded portion 11, and the elastic locking pawl 16 is caused to engage with the inner surface of the connector housing 1, the spacer 6 is held in parallel with the connector housing 1; that is, the spacer 6 has been temporarily locked to the connector housing 1. With the spacer 6 temporarily locked in the above-described manner, the terminal accommodating chambers 3 are axially open and clear, so that terminals 5 may be inserted into the terminal accommodating chambers 3. When, under this condition, a terminal 5 is inserted into the respective terminal accommodating chamber 3 from behind, the lance 4 is engaged with a locking hole 21 formed in the terminal 5; that is, the latter 5 is primarily locked. Next, the top wall 8 of the spacer 6 is pushed downwardly to further insert the spacer 6 into the connector housing 1. As a result, the flexible walls 9 of the spacer 6 are elastically outwardly bent, so that, as shown in FIG. 7 the locking protrusions 10 of the flexible walls 9 are slid on the right and left walls of the protruded portion 11, and engaged with the engaging grooves 15, respectively. Thus, the spacer 6 has been finally locked to the connector housing 1; that is, the removal of the spacer 6 is prevented. Under this condition, the terminal 5 is secondarily locked; that is, as shown in FIG. 8, the terminal locking pieces 14 are fitted in the rear end portion 22 of the terminal 5 so that the terminal 5 is prevented from being removed backwardly.

When the terminal is incompletely inserted, the spacer 6 functions as follows:

FIGS. 9 and 10 are diagrams outlining the function of the spacer 6.

In the case where all of the terminals 5 are satisfactorily inserted into the housing, the spacer functions as follows: As was described before, in the temporary locking state that the spacer 6 is held horizontal, the top wall 8 is depressed uniformly, so that the locking protrusions 10 are engaged with the engaging grooves 9; that is, the spacer 6 is finally locked to the connector housing. Thus, the temporary locking state has been smoothly switched over to the final locking state. On the other hand, in the case where the insertion of at least one of the terminals 5 into the connector housing is unsatisfactorily, the following trouble occurs when the spacer is placed in the final locking state from the temporary locking state: As shown in FIG. 10, on one side where the terminal is incompletely inserted into the connector housing, the terminal locking pieces 14 are shifted aside striking against the electrical connecting part 23 (cf. FIG. 1) of the terminal. When, under this condition, the top wall 8 is further depressed, as is apparent from FIG. 10 on the other side where the terminals are satisfactorily inserted, the end portion of the flexible wall 9 is pushed outwardly being slid on the protruded portion 11; while on the one side where the terminal is not satisfactorily inserted, the flexible wall 9 is pushed outwardly with its locking protrusion 10 abutting against the protruded portion 11.

When the flexible walls 9 and 9 are pushed outwardly in the above-described manner, a stress of restoring the flexible walls 9 provides a moment to swing the spacer 6 in the direction of the arrow F (cf. FIG. 10). When the spacer 6 is released; that is, upon the removal of the spacer depressing force, the moment acts as a force to raise the spacer 6. As a result, the spacer 6 is placed in the temporary locking state again. Hence, the double-lock type connector of the invention is free from the difficulty accompanying the conventional double-lock type connector that, when the spacer is placed in the final locking state, only a part of the spacer is fixedly locked to the connector housing. This feature eliminates the difficulty that the double-lock type connector in which the spacer is incompletely locked to the connector housing is passed through the inspection.

Even when, in the case where at least one terminal is unsatisfactorily inserted into the connector housing, the top wall 8 is depressed, the spacer is raised and placed in the temporary locking state again. Hence, it can be readily detected with a checker or the like whether or not the terminals have been satisfactorily inserted into the connector housing.

When the spacer 6 is fixedly engaged with the connector housing 1, the flexible walls 9 are flexed outwardly, which prevents the locking protrusions 10 from being made dull. Hence, the spacer 6 may be used repeatedly, and it can be smoothly engaged with the connector housing 1 at all times.

In the above-described embodiment, the locking protrusions 10 are formed on the flexible walls 9, and the locking walls 15 are formed in the protruded portion 11; however, the invention is not limited thereto or thereby. That is, it goes without saying that the connector may be so modified that, as shown in FIG. 11, the locking protrusions 10 are formed on the protruded portion 11, while the locking grooves 15 are formed in the flexible walls 9.

In the above-described embodiment, the connector housing is provided for female type terminals; however, the invention is not limited thereto or thereby. That is, the technical concept of the invention is applicable to a connector housing for male type terminals.

FIG. 12 (corresponding to FIG. 6) shows a second embodiment of the invention.

In the second embodiment, a connector housing 31 has a first recess 32 and a second recess 33 in its portion which is confronted with the elastic locking pawl 16 of the spacer 6, in such a manner that the elastic locking pawl 16 is engageable with the first and second recesses 32 and 33. When the elastic locking pawl 16 is engaged with the first recess 32, the spacer 6 is placed in the temporary locking state; and when it is engaged with the second recess 33, the spacer 6 is placed in the final locking state.

In the second embodiment, the first and second recesses are used in combination with the locking protrusions 10 and the engaging grooves 15 in the first embodiment shown in FIGS. 1 through 8, which increases the mechanical strength of the locking mechanism of the spacer 6. Hence, the spacer can be smoothly locked to the connector housing even after it is used repeatedly.

In the double-lock type connector of the invention, the spacer locking mechanism is made up of: the pair of flexible walls which are extended downwardly from the top wall with a predetermined space between them; the protruded portion of the connector housing which internally touches the flexible walls; the first engaging parts formed on the inner surfaces of the flexible walls which are confronted with each other, and the second engaging parts formed on the side walls of the protruded portion so as to be engaged with the first engaging parts. Hence, the double-lock type connector of the invention is free from the difficulty that, when the spacer is placed in the final locking state with a terminal or terminals inserted unsatisfactorily into the connector housing, the spacer is partially locked to the connector housing. In this case, the spacer is raised, and it is placed in the temporary locking state again. Accordingly, it can be readily determined whether the spacer is in the temporary locking state or whether it is in the final locking state. In addition, it can be positively detected with the checker whether or not a terminal or terminals are completely inserted into the connector housing.

When the spacer is locked, the flexible walls are bent outwardly. Hence, even if the spacer is placed in the temporary locking state and the final locking state repeatedly, the engaging parts formed on the inner surfaces of the flexible walls are scarcely worn. Hence, the spacer can be smoothly locked to the connector housing at all times.

What is claimed is:

1. A double-lock type connector comprising:

a connector housing including terminal accommodating chambers, said connector housing having a cavity which is extended across said terminal accommodating chambers, opened in the an outer wall of said connector housing having an opening communicating with said cavity;

a spacer insertable through said opening and into said cavity, said spacer being moveable from a temporary locking state, in which terminals are insertable into said terminal accommodating chambers, to a final locking state, in which said terminals are retained in said terminal accommodating chambers by said spacer, said spacer including:

a top wall similar in configuration to said opening; and a pair of elastically deformable flexible walls which are extended downwardly from said top wall and defining a space therebetween, said connector housing having an internal protruded portion which is received in said space such that said flexible walls slidably engage opposing faces of said protruding portion; and locking means for locking said spacer in the temporary locking state and in the final locking state, wherein when said spacer is forcibly moved from the temporary locking state toward the final locking state under a condition where at least one of said terminals is not completed inserted, said spacer is automatically returned to the temporary locking state by an elastic restoring force of said flexible walls acting on said protruding portion after said force is removed even when a portion of said Spacer has been locked in said final position by said locking means.

2. A double-lock type connector as claimed in claim 1, wherein said locking means is formed in said spacer and said connector housing.

3. A double-lock type connector as claimed in claim 2, wherein said locking means includes at least one of:

first engaging member formed on the inner surfaces of said flexible walls and the outer surface of said protruded portion so as to be engaged with said inner surfaces of said flexible walls; and second engaging member formed on an elastic locking pawl formed on the edge of said top wall and an edge portion of an opening of said cavity.

4. A double-lock type connector as claimed in claim 3, wherein said first engaging member includes one of either protrusions and recesses and said second engaging member includes one of recesses and protrusions.

* * * * *